United States Patent [19]

Nakagawa et al.

[11] 4,057,698

[45] Nov. 8, 1977

[54] SWITCHING MECHANISM OF A TIMEPIECE

[75] Inventors: Yasuichi Nakagawa, Kashiwa; Masataka Ikenishi, Soka; Yoshio Hozumi, Tokyo; Shozo Kushida, Chiba; Koichi Tsukutani, Matsudo, all of Japan

[73] Assignee: Kabushiki Kaisha Daini Seikosha, Japan

[21] Appl. No.: 674,844

[22] Filed: Apr. 7, 1976

[30] Foreign Application Priority Data

Apr. 8, 1975 Japan ..... 50-47192[U]

[51] Int. Cl.[2] ..... H01H 3/32; H01H 15/24; G04C 3/00

[52] U.S. Cl. ..... 200/16 A; 58/23 R; 58/50 R; 58/85.5; 200/52 R; 200/163; 200/165

[58] Field of Search ..... 200/4, 11 R, 52 R, 159 R, 200/16 A, 163, 165; 58/4 A, 4 R, 23 R, 23 A, 50 R, 58, 63, 73, 85.5, 88 B, 90 R, 90 B

[56] References Cited

U.S. PATENT DOCUMENTS

| | | | |
|---|---|---|---|
| 3,733,803 | 5/1973 | Hiraga et al. | 58/23 R |
| 3,745,758 | 7/1973 | Kuritz | 58/23 A |
| 3,783,607 | 1/1974 | Feurer | 58/90 B |
| 3,846,971 | 11/1974 | Ho et al. | 58/23 R |
| 3,935,700 | 2/1976 | Haaften | 58/4 A |
| 3,952,176 | 4/1976 | Holder et al. | 200/11 R |
| 3,974,351 | 8/1976 | Solov et al. | 200/159 R |
| 3,978,296 | 8/1976 | Moriya et al. | 200/4 |
| 3,998,044 | 12/1976 | Yamguchi et al. | 58/23 R |

*Primary Examiner*—James R. Scott
*Attorney, Agent, or Firm*—Robert E. Burns; Emmanuel J. Lobato; Bruce L. Adams

[57] ABSTRACT

A switching mechanism for a timepiece comprising a base plate having first and second bores extending therethrough and intersecting, a circuit board having a surface opposite the second bore and having stationary contacts mounted on the surface opposite the second bore, and a contact member disposed within the second bore and dimensioned to slide therein. The contact member has a transverse bore extending therethrough and alignable with the first bore through the base plate, and the contact member has a conductive lower end portion extending from the base plate and terminating at a contact surface for contacting to electrically connect the stationary contacts on the circuit board. A spring biases the contact member downwardly to a lowered position with the contact surface contacting the stationary contacts on the surface board. A timepiece adjusting stem has an end portion dimensioned for insertion into the first bore and into the traverse bore for maintaining the contact member at a raised position with the contact surface thereof raised from the stationary contacts, and the adjusting stem is slideably mounted in a position aligned with the second bore for permitting the adjusting stem to travel in an axial direction thereof between a retracted position with the stem clear of the transverse bore of the contact member and an operative position with the stem inserted into the first bore of the base plate and into the transverse bore of the contact member to maintain the contact member in a raised position. The transverse bore has a tapered converging portion converging in an inward direction of the contact member so that the end portion of the stem bears against the tapered portion as the stem travels from the retracted to the operative position thereby causing the contact member to rise as the tapered portion of the transverse bore climbs the end portion of the stem traveling inwardly of the contact member until the stem extends into the transverse bore to maintain the contact member in a raised position.

3 Claims, 4 Drawing Figures

SWITCHING MECHANISM OF A TIMEPIECE

BACKGROUND OF THE INVENTION

This invention relates to a switching mechanism which is able to be employed in a small-sized electronic watch.

Generally, a conventional switching mechanism for electronic watches comprises a winding stem of the type used also in a mechanical watch, a setting lever, a clutch lever and other members actuated by said winding stem. However, the movements of the setting lever, clutch lever and said other members are effected on a horizontal plane when said winding stem is actuated. As a result, the conventional switching mechanism requires a large space within the limited space of the watch because of the horizontal actuation of said members. Further, a switching spring member B as shown in FIGS. 1 and 2 has been proposed, however it is also horizontally actuated by a winding stem A. In this case, there is the same disadvantage as that of above-mentioned mechanism.

SUMMARY OF THE INVENTION

It is therefore an object of the present invention to eliminate the above-mentioned drawbacks and to provide an improved switching mechanism which is suitable to be employed in a small-sized electronic watch.

DESCRIPTION OF THE PREFERRED EMBODIMENT

The present invention will be fully described by way of the illustrated preferred embodiment in connection with the accompanying drawings.

Figure 1:
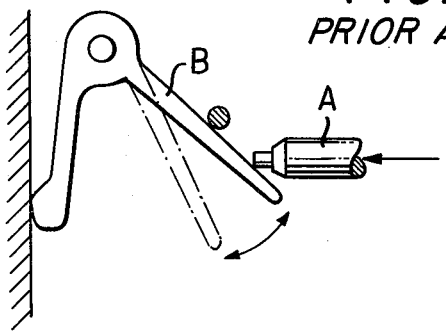
FIG. 1 PRIOR ART
FIGS. 1 and 2 illustrate conventional timepiece switching mechanisms.
Figure 2:
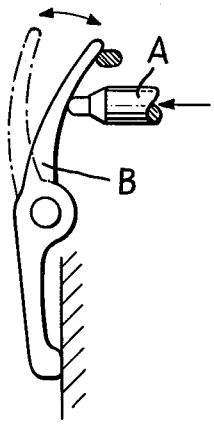
FIG. 2 PRIOR ART
Figure 3:
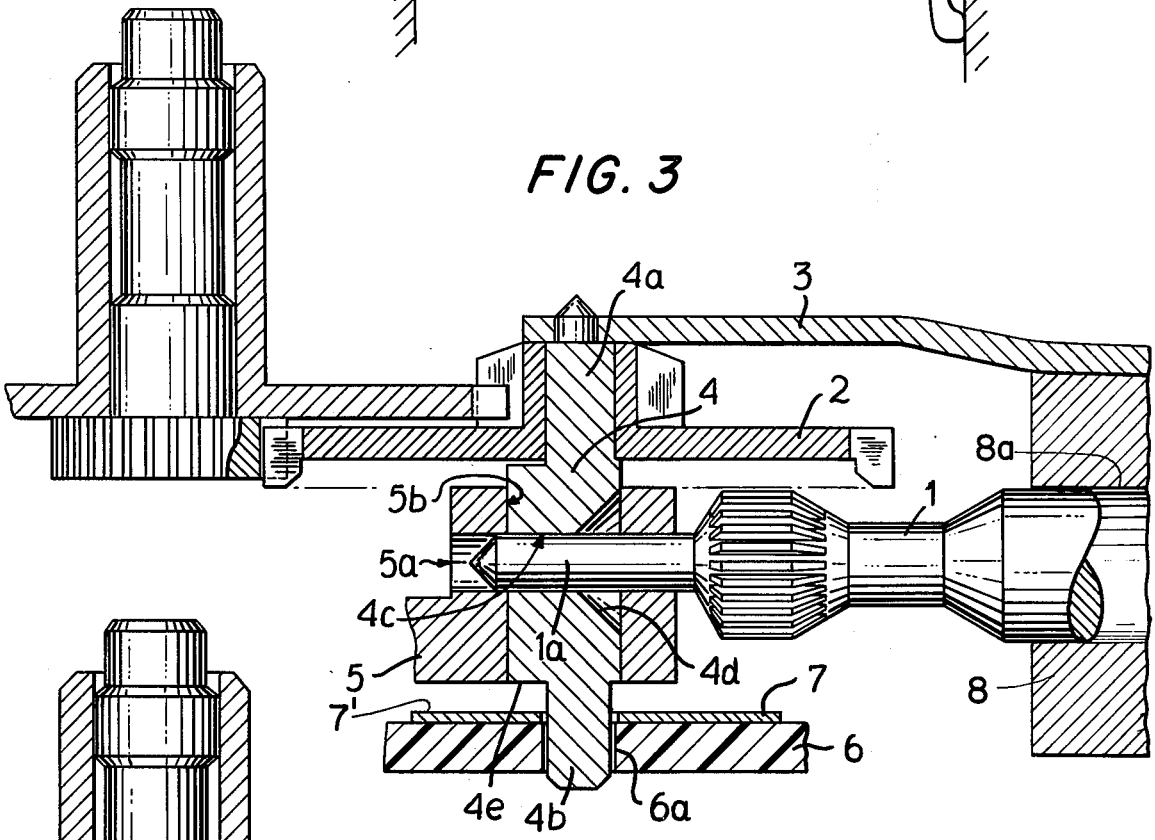
FIG. 3 is a partial sectional view of the switching mechanism of the present invention set to an off condition.

Referring to FIG. 3, there is shown a switching mechanism of the present invention where the switching state thereof is set under an OFF condition. The switching mechanism comprises a winding or adjusting stem 1, a minute gear wheel 2, a spring member 3, a movable contact member 4, a base plate(or a bridge) 5, and a circuit block or board 6. The base plate (or bridge) 5 is provided with a hollow first bore 5*a* for receiving an internal end portion 1*a* of the winding stem 1. The base plate or bridge 5 is provided with a hole or second bore 5*b* which crosses said hollow 5*a*. In the hole 5*b* of the base plate 5, the movable contact member 4 is slidably inserted. The movable contact member 4 has at one end a center shaft portion 4*a* for the rotation of the minute wheel 2 while the other end of the contact member 4 has a downwardly extended shaft portion or guide 4*b* serving as a holding and a guiding portion which is inserted into a hole 6*a* of a circuit block or insulated printed circuit board 6. In a substantially middle portion of the movable contact member 4 is a hollow transverse bore 4*c* which exactly corresponds to said hollow bore 5*a* of the base plate or the bridge 5. The hollow 4 of the contact member 4 has a tapered rim 4*d* at one side from which the winding stem is inserted therein.

When the movable contact member, which is inserted in the hole 5*b* of the bridge, is supported by the winding stem 1 inserted into the hollow 4*c*. As shown in FIG. 3, the lower step portion 4*e* is raised above the circuit board 6. The spring member presses down against the upper end of the movable contact member 4 and biases it together with the minute wheel 2 toward the circuit block 6. A pair of immovable contact members 7, 7', which may be printed circuit lands on the circuit block 6, are disposed around the extended shaft portion 4*b* of the movable contact member 4. The immovable contact members 7, 7' disposed around the extended shaft portion 4*b* are opposed to the step portion 4*e* of the movable contact member 4, so that an electrical connection between both contact members 7, 7' is effected when the contact member 4 is moved downward to the position shown in FIG. 4 with the step portion 4*e* of the movable contact member 4 in contact with the faces of the immovable contact members 7, 7'. In this contact position the downward movement of the movable contact member 4 for making electrical contact with the immovable contact members is limited by the printed circuit contact members 7, 7'.

Describing next the operation of the switching mechanism according to the present invention, the winding stem 1 shown in FIG. 3 is positioned at a normal or inserted operation position. In this case, since the winding stem is exactly inserted in the lateral bore 5*a* of the base plate or bridge 5 and the bore 4*c* of the movable contact member 4, the movable contact member 4 is supported by the winding stem and spaced away from the immovable or stationary contact members 7, 7'. Therefore, there is no electrical connection between both contact members.

Figure 4:
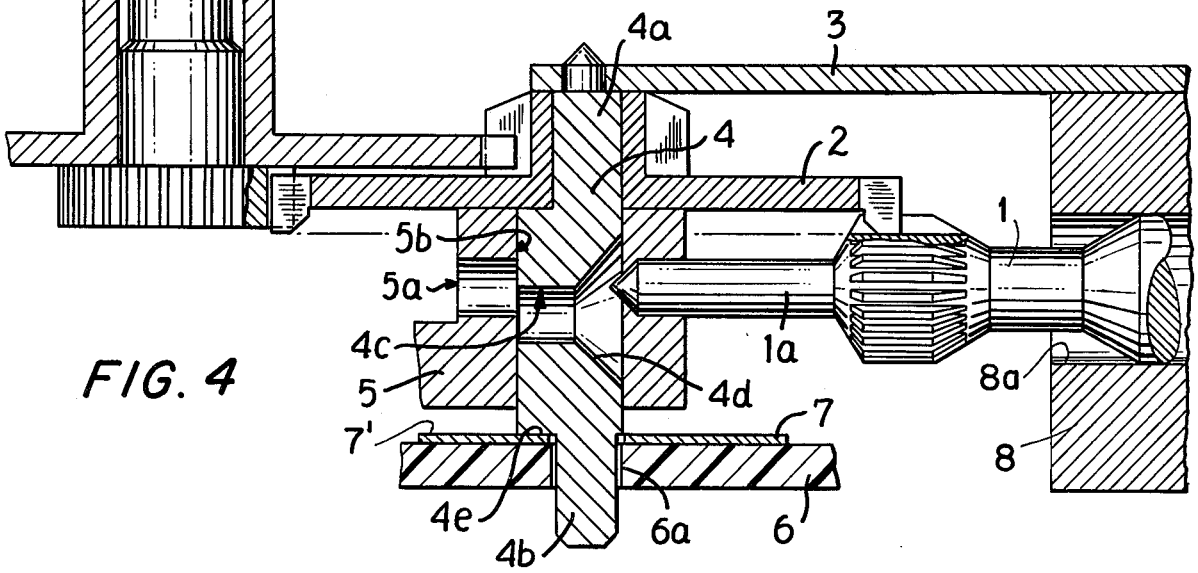
FIG. 4 is a partial sectional view of the switching mechanism according to the invention showing the mechanism in an on condition.

Referring to FIG. 4, both contact members 7, 7' are contacted by the conductive lower end step portion 4*e* of the movable contact member 4 which defines a contact surface for contacting the stationary contacts. For this purpose, the winding stem 1 is pulled out to a retracted position so that the end 1*a* of the stem 1 clears the bore 4*c* of the movable contact member 4. At this time, the movable contact member 4 which is pressed by the spring member 3 moves downwardly so as to come in contact with the immovable contact members 7 7', so that the step portion 4*e* of the movable contact member 4 is in contact with the contact face of the immovable contact members 7, 7'. The spring member 3 attached to the mounting block 8 defines means for biasing the contact member 4 to a lowered position with the contact surface thereof contacting the stationary contacts. In this way the electrical contact between both contact members is effected. By making use of the electrical switching mechanism, the electronic circuit of a watch is able to be reset for stopping the drive the watch indicating hands. In this case, the movable contact member 4 is earthed to the winding stem, base plate or other such mechanical parts.

For releasing or opening the electrical contact between both contact members, the winding stem 1 is pushed to an operative position so that the internal end 1*a* thereof is inserted into the tapered portion 4*d* of the bore 4*c* of the movable contact member 4, whereby the tapered portion 4*d* climbs the end 1*a* of the stim and the movable contact member 4 is pushed up by the winding stem to disengage from the immovable contact members 7, 7'. As illustrated, the stem 1 is mounted and positioned by the mounting block 8 having a bore 8*a* aligned with the first bore 5*a* through the base plate 5, and the stem 1 is slidable between the retracted and the operative position. The mounting block 8 having bore 8*a* defines mounting means slidably mounting the adjusting stem 1, and its structure is not critical.

In the above-mentioned embodiment, as illustrated, movement of the movable contact member is effected by the engagement of the bore of the movable, contact member with the winding stem or the disengagement therebetween, but the invention is not limited to this structure and modifications and changes are possible. For example, the movable contact member may be moved in a square crossing to the winding stem by a cam which has a tapered portion and mounted around the winding stem in such a way that it moves reversely in cooperation with the operation of the winding stem.

Further, the switching mechanism according to the present invention is not limited to use in an analog display electronic watch; it may be employed in a digital display electronic watch.

Furthermore, it is obvious that it is possible to make several contacts for several switching functions by providing several immovable contact members on opposite sides of the movable contact member or within a shift area of the movable contact member.

As mentioned above, the switching mechanism according to the present invention brings about many advantages as follows: since the movable contact member moves vertically relative to the axial movement of the winding stem caused by the pulling or pushing operation of the winding stem, the space of the switching mechanism of the present invention is very small, and the structure of the switching mechanism is very simple and a small-sized electronic watch is obtained.

We claim:

1. A switching mechanism for a timepiece, comprising:

a base plate having a first bore extending therethrough and having a second bore extending therethrough and intersecting said first bore;

a circuit board having a surface opposite said second bore and having stationary contacts mounted on said surface opposite said second bore;

a contact member dimensioned to slidably fit within the second bore of said base plate and having an axial dimension aligned with said second bore, said contact member having a transverse bore extending therethrough and alignable with the first bore through said base plate, and said contact member having a conductive lower end portion extending from said base plate and terminating at a contact surface for contacting said stationary contacts on said circuit board to complete an electrical connection therebetween;

biasing means comprising a spring for biasing said contact member downwardly to a lowered position with said contact surface contacting said stationary contacts on said circuit board;

an adjusting stem having an end portion dimensioned for insertion into the first bore through said base plate and into the transverse bore through said contact member for maintaining said contact member at a raised position with said contact surface thereof raised from said stationary contacts on said circuit board so that said stationary contacts are in an unconnected condition; and mounting means slidably mounting said adjusting stem in an aligned position aligned with the second bore through said base plate for permitting said adjusting stem to travel in an axial direction thereof between a retracted position with said stem clear of the transverse bore through said contact member with said contact member at the lowered position and an operative position with said stem inserted into the first bore of said base plate and into the transverse bore of said contact member to maintain said contact member in the raised position, and wherein said contact member and said stem together include means for raising said contact member from the lowered to the raised position as said stem travels from the retracted to the operative position.

2. A switching mechanism for a timepiece according to claim 1, wherein said means for raising said contact member comprises a tapered converging portion of the transverse bore through said contact member converging in an inward direction of said contact member, and said end portion of said stem which bears against said tapered portion of said transverse bore as said stem travels from the retracted to the operative position thereby causing said contact member to rise as said tapered portion of said transverse bore climbs the end portion of said stem travelling inwardly of said contact member until said stem extends into said transverse bore to maintain said contact member in the raised position.

3. A switching mechanism according to claim 1, wherein said stem is a winding stem having a plurality of gear teeth disposed circumferentially thereof along a length portion of said stem.

* * * * *